US006338364B1

(12) United States Patent
Mendenhall

(10) Patent No.: US 6,338,364 B1
(45) Date of Patent: Jan. 15, 2002

(54) INSERT FOR FREEZE PROTECTING WATER PIPES

(76) Inventor: Burke H. Mendenhall, P.O. Box 1803, Carmel, IN (US) 46032

( * ) Notice: Subject to any disclaimer, the term of this patent is extended or adjusted under 35 U.S.C. 154(b) by 0 days.

(21) Appl. No.: 09/652,577

(22) Filed: Aug. 31, 2000

Related U.S. Application Data

(60) Provisional application No. 60/151,890, filed on Sep. 1, 1999.

(51) Int. Cl.[7] ..... E03B 7/10
(52) U.S. Cl. ..... 138/32; 138/27; 138/28
(58) Field of Search ..... 138/32, 26, 28, 138/27, 30; 137/59

(56) References Cited

U.S. PATENT DOCUMENTS

| | | | | |
|---|---|---|---|---|
| 596,062 A | 12/1897 | Firey | 138/28 X |
| 2,029,630 A | 2/1936 | McMichael | 138/28 |
| 2,599,325 A | 6/1952 | Fritzberg | 138/28 |
| 2,629,402 A | 2/1953 | Cook | 138/28 |
| 3,143,861 A | 8/1964 | Dumas | 138/26 X |
| 4,440,154 A | 4/1984 | Bellows | 126/438 |
| 5,058,627 A | 10/1991 | Brannen | 138/32 X |
| 5,538,043 A | 7/1996 | Salazar | 138/26 |
| 6,009,906 A | 1/2000 | Salazar | 138/28 |
| 6,119,729 A | 9/2000 | Oberholzer et al. | 138/32 X |

*Primary Examiner*—Patrick Brinson
(74) *Attorney, Agent, or Firm*—Burke H. Mendenhall; Pro Se

(57) ABSTRACT

The invention is a round, flexible, hollow tubular insert to be affixed in a central position within pressurized sprinkler pipes, water pipes and water mains. The insert will be employed to prevent sprinkler pipe, water pipe and water main ruptures due to the water within the sprinkler pipe, water pipe or water main freezing. The insert is constructed of a thin-walled, flexible material that is capable of being deformed (e.g. compressed), thereby absorbing the expansion pressures exerted by the water in a frozen state (i.e., ice). The insert is constructed with guides to maintain a position in the center of sprinkler pipes, water pipes and water mains to absorb the radial freezing of water. By such absorption, the outer sprinkler pipe, water pipe or water main itself will not be over-pressurized, thereby avoiding the possibility of a rupture. Upon the thawing of the frozen water, the flexible, hollow, tubular insert will return to its original shape.

8 Claims, 1 Drawing Sheet

INSERT FOR FREEZE PROTECTING WATER PIPES

This appln claims benefit of Prov. No. 60/151,890 filed Sep. 1, 1999.

FIELD OF THE INVENTION

The invention pertains to pressurized water pipes, sprinkler pipes, and water mains in general, and more particularly to a manner of preventing the failure or rupture of a water pipe, sprinkler pipe, or water main due to the water held therein freezing.

DESCRIPTION OF THE PRIOR ART

Pressurized water pipes, sprinkler pipes, and water mains are in use in various round sizes throughout the civilized world. Water pipes, sprinkler pipes, and water mains are pressurized from a pumping station, and distribute water from the pumping station into faucets, toilets, showerheads, etc. for eventual use by the consumer. In the case of the sprinkler pipes, the pressure from the pumping station is maintained in a static state until there is a triggered activation, thereby dispensing the water through the sprinkler pipe until manually shut off.

One major problem associated with all types of water pipes, sprinkler pipes, and water mains is the freezing of the pressurized water when temperatures drop to sub-freezing levels for extended periods of time. When exposed to extended periods of sub-freezing temperatures, pressurized water pipes, sprinkler pipes and water mains will form ice crystals radially from the outside circumference of the pipes, which will progress inward until an ice plug is formed. When the ice plug completely blocks the pipe, it seals water between the plug and the closed valve. As additional ice forms between the plug and the closed valve, the ice runs out of room to expand, thus causing the pipe to burst at it weakest point. When the temperature warms to above freezing temperatures, returning the ice to a liquid state, the pipe rupture will leak, causing property damage such as contaminated water and weakened foundation.

In the past, two general methods have surfaced to address the protection of pressurized water pipes from sub-freezing temperatures:

1. The wall thickness of water pipes, sprinkler pipes, and water mains are increased to withstand the forces imposed by the freezing water.

The increase in pipe wall thickness greatly increases the cost of the water pipes, sprinkler pipes and water mains. Also, increasing the pipe's wall thickness is not fool proof. If the ice plug extends far enough, the pipe can still rupture.

2. A controlled heat source, such as heat tape, is employed to restrain the water in the pipes from dropping into below freezing temperatures.

Such external heaters significantly increase the cost of water pipes and mains due to the added complexity, and the requirement that the protective heat tape also be protected from the elements while still supplying heat to the pipes and mains. Also, such heaters do not provide protection when power is not available (e.g., power failure), which often occurs as the result of the sudden onslaught of extreme cold, wind, and sub zero temperatures.

The object of this invention is to provide:

- a method for preventing damage to water pipes, sprinkler pipes, and water mains resulting from the formation of ice plug therein.

- constant freeze protection to water pipes, sprinkler pipes and water mains without the added expense of an external power source.
- freeze protection that will not interfere with the functional operation of the water pipes, sprinkler pipes and water mains.
- freeze protection that will neither break down nor undergo a reduction of its ability to protect over time.
- freeze protection at low cost and with only marginally increased production costs.

SUMMARY OF THE INVENTION

This invention pertains to a method of protecting water pipes, sprinkler pipes, and water mains from rupture caused by the freezing of water contained therein. The water contained in these pipes is constantly under pressure from a central pumping station. The pressure is maintained through the practical application of reducing the radius of the pipe as it extends from the pumping station. The invention consists of a round, flexible insert, made of a flexible plastic or polymer material. The insert is equipped with guides to maintain a central position within the water pipes, sprinkler pipes, and water mains. The insert will maintain its round shape at a pressure greater than the water in the pipes when the water is in a fluid state. The insert is generally constructed of a thin-walled polymer that can flex or be compressed without failing. Consequently, as the water within the water pipes, sprinkler pipes and water mains freezes, the insert contained therein is compressed by the greater forces exerted by the frozen water. The compression of the insert prevents the over-pressurization or structural failure of the water pipes, sprinkler pipes, and water mains. When the ice within the water pipes, sprinkler pipes, and water mains returns to liquid state, the insert flexes back to its original pre-formed shape at the center of the water pipe.

BRIEF DESCRIPTION OF THE DRAWINGS

FIG. 1 is a cross section.

FIG. 2 is a perspective.

FIG. 3 is a cross section of the collar.

DETAILED DESCRIPTION OF THE PREFERRED EMBODIMENTS

Figure 1:
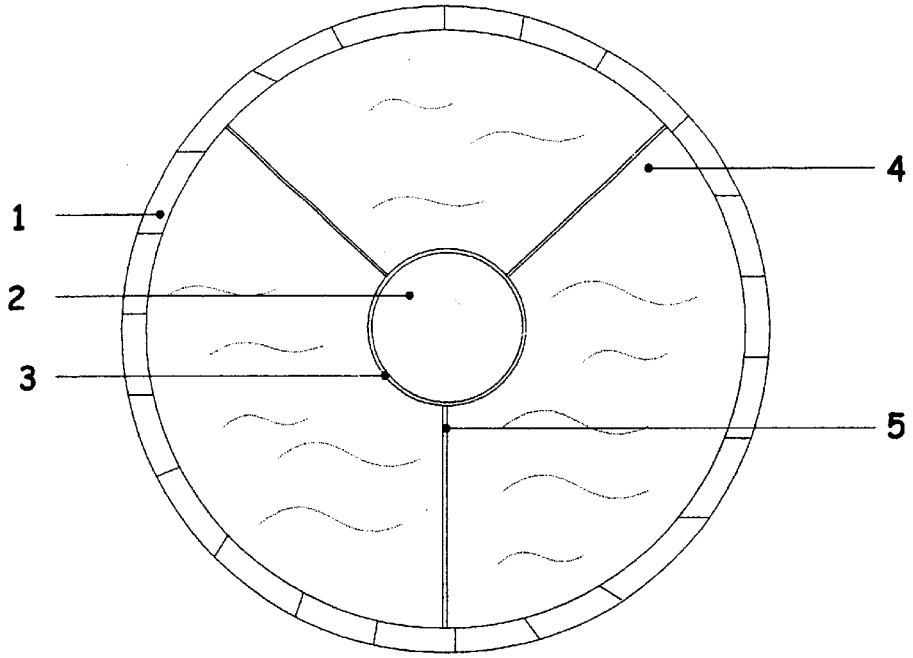
FIGS. 1, 2, and 3 are located on page 10 of this document.

Referring initially to FIG. 1, There is displayed a pictorial view of a round water pipe 1 with water at a pressure sufficient to deliver the water to end consumption.

To prevent the pressurized water pipe 1 from structural failure due to the expansion of the water 4 into its frozen state, a flexible, compressible round insert is placed in the center of the pipe 3.

The insert 3 is sustained in the center of the pipe by guides 5, which extend from the insert 3 to the walls of the pipe 1. The guides 5 are of equal distance from the inside dimension of the pressurized water pipe 1 to maintain the central position of the round insert 3. The insert 3 extends along the entire length of the pipe 1, or the sections of the pipe 1 that will be subject to extreme cold temperatures. The extension of the insert 3 in this manner will prevent the pressurized water pipe 1 from incurring structural failure.

Figure 2:
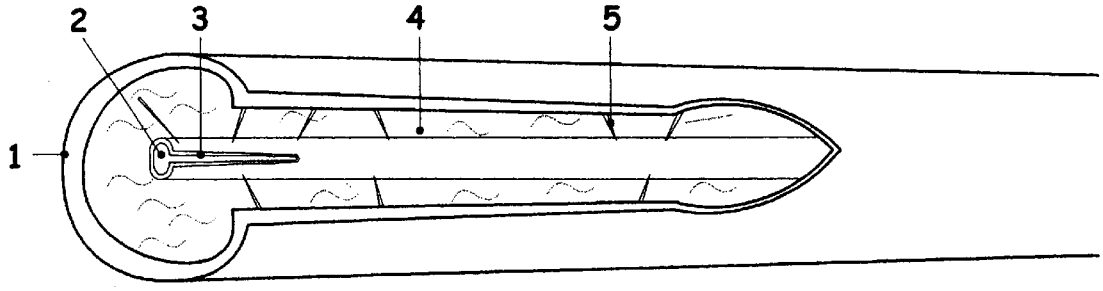

FIG. 2 illustrates a cross section of the pressurized water pipe 1 with the insert 3 displayed in its central position. The figure shows that the insert 3 is a thin-walled round tube made of a flexible and compressible plastic, polymer, or similar material that will retain its integrity in extreme cold temperatures. The guides 5 or arms are of the same material as the insert 3, and are molded to extend from the outer dimension of the insert 3 to the inside dimension of the pressurized water pipe 1. The insert 3 is hollow and is fully sealed on all ends and sides, and extends the desired distance in a central position of the pressurized water pipe 1 to protect against freezing temperatures and the resulting failure of the pipe 1 due to the expansion of ice 4. The inventive feature of the insert 3 is its construction with a sealed, thin, impermeable, and easily deformed material in a round shape with equal length guides to maintain the insert in the center of the pipe 1.

The insert 3 is formed with a sidewall compression strength greater than the pressurized water 4 in its liquid state. The insert 3 maintains a positive pressure of air 2 in the volume of the insert 3. In other words, the wall compression strength and positive pressure of the air 2 is greater than the external forces of the pressurized water 4 acting upon the insert 3 when the pressurized water 4 is in its liquid state. However, when the pressurized water 4 freezes, the resultant ice will expand, thereby generating pressures greater than the sidewall, as well as the external pressure of the insert 3. When water pipes 1 are exposed to freezing temperatures, ice is formed radially, from the inside wall of the pipe 1 until an ice plug is formed. The expansion of ice 4 must be absorbed in the center of the pipe. Consequently, rather than causing the water pipe 1 to rupture, the compressing/expanding pressures caused by the water 4 in its movement to and from frozen/liquid state are easily accommodated by the compression/expansion of the centrally-located insert 3.

Figure 3:
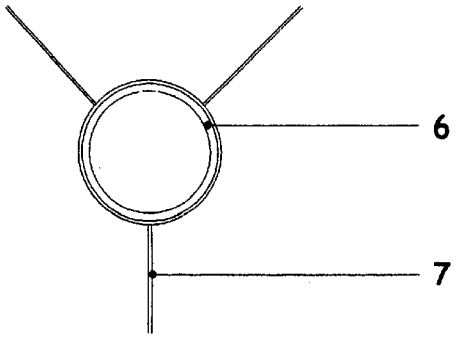

FIG. 3 illustrates the insert maintained in a cross section view by a collar 6 instead of guides as shown in FIGS. 1 and 2. The collar 6 will make the insert usable in odd-sized or seldom used types of pipes 1. This configuration will satisfy installation of the insert 3 in cases of short supply, or for emergency installations. The insert 3 will be manufactured in the same manner as described earlier, with the exception that the guides 7 and collar 6 will be manufactured separately, and the insert 3 will not be installed in the pressurized water pipe 1 until after the guides 7, by separate process, have been attached to the insert 3.

As stated earlier, the insert 3 will extend the length of the pressurized water pipe 1 or the desired distance of the pipe requiring freeze protection. During a period of freezing of the pressurized water 4 in the water pipe 1, the expansion of the pressurized water 4 will cause the insert to be compressed. This will prevent the buildup of freezing pressures against the walls of the water pipe 1, thereby eliminating the possibility of the water pipe 1 incurring structural failure and causing catastrophic leaks in structures or to the supply mains which are subject to extreme cold temperatures. Once the water returns to above freezing temperatures, the positive pressure 2 in the insert 3 and the flexible and compressible sidewall construction of the insert 3 will return the insert 3 to its original shape in the center of the pressurized water pipe 1.

The most important features of the insert are displayed as follows:

a) the insert 3 is constructed of round, flexible compressible plastic or polymer b) the insert 3 is sealed on the ends and is water tight c) the insert 3 has molded guides 5 or arms, which maintain the inert 3 in a central position of the pressurized water pipe 1 d) the insert 3 will maintain its ability to flex and compress upon the repeated freezing of the pressurized water 4 in the water pipe 1 and return to its original shape upon the advent of above freezing temperatures e) the insert 3 has a positive pressure of air 2 that is greater than the pressurized water 4 in its liquid state f) the insert 3 extends the entire length of the pressurized water pipe 1 that requires freeze protection g) the insert 3 is retained in the center of the pressurized water pipe 1 to absorb the expanding pressures of freezing pressurized water 4 h) the insert 3 is maintained in a central position by the use of guides 5 or arms that are molded into the insert 3 during manufacture, or by a collar 6 that is constructed separately, and inserted by threading it through the molded guides 7 prior to insertion into the pressurized water pipe 1 i) the insert 3 is constructed of a molded plastic, polymer, PVC, or other type of flexible material that can withstand repeated exposure to sub-freezing temperatures, be compressed or deformed to absorb the frozen water 4 and return to its original shape without adverse reactions to the water 4 or the pressurized pipe 1.

What is claimed is:

1. An insert for preventing structural failure to pressurized water pipes, sprinklers, pipes or water mains due to prolonged exposure to sub-freezing temperatures, said insert comprising a round, elongated, waterproof, flexible, air filled hollow tube, said air filled hollow insert having an internal pressure greater than that of the pressurized water in a non-frozen state, said insert being compressed upon the freezing of pressurized water, thereby accommodating such expansion of the pressurized water within the confines of the pipe without over pressurizing the pipe, said insert expanding in volume when the temperature of the water returns to a liquid state.

2. The insert of claim 1, wherein said hollow insert is centrally located within the pressurized water pipe by arms or guides of equal length extending from the outside surface of the insert to the inside surface of the water pipe.

3. The insert of claim 2, wherein the longitudinal axis of the hollow insert is generally parallel to the longitudinal axis of the pipe.

4. The insert of claim 3, wherein the longitudinal axis of the hollow insert is coaxial with the longitudinal axis of the pipe.

5. The insert of claim 4, wherein the material used to construct the hollow insert is plastic, PVC, or polymer.

6. The insert of claim 5, wherein the material used to construct the arms or guides is plastic, PVC or polymer.

7. The insert of claim 6, wherein the hollow insert arms or guides are attached by collar or by mold.

8. The insert of claim 7, wherein the hollow insert extends the entire length of the water pipe requiring freeze protection.

* * * * *